US011668471B2

(12) United States Patent
Kubtan et al.

(10) Patent No.: US 11,668,471 B2
(45) Date of Patent: Jun. 6, 2023

(54) GLIDE RACK ASSEMBLY FOR A COOKING CHAMBER

(71) Applicant: Electrolux Home Products, Inc., Charlotte, NC (US)

(72) Inventors: Muhammad Hussam Kubtan, Gallatin, TN (US); Steven Todd Brooks, Springfield, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 275 days.

(21) Appl. No.: 17/101,115

(22) Filed: Nov. 23, 2020

(65) Prior Publication Data

US 2021/0071875 A1 Mar. 11, 2021

Related U.S. Application Data

(63) Continuation of application No. 16/201,233, filed on Nov. 27, 2018, now Pat. No. 10,876,737.

(51) Int. Cl.
*F24C 15/16* (2006.01)

(52) U.S. Cl.
CPC ..... *F24C 15/16* (2013.01)

(58) Field of Classification Search
CPC ..... F24C 15/16
See application file for complete search history.

(56) References Cited

U.S. PATENT DOCUMENTS

| | | | |
|---|---|---|---|
| 5,405,195 | A | 4/1995 | Hobbs |
| 6,938,617 | B2 | 9/2005 | Le et al. |
| 7,216,646 | B2 | 5/2007 | Le et al. |
| 7,942,486 | B2 | 5/2011 | Petri |
| 8,047,199 | B2 | 11/2011 | Le et al. |
| 8,490,801 | B2 | 7/2013 | Smith et al. |
| 8,820,314 | B1 | 9/2014 | Johnson et al. |
| 9,408,462 | B1 | 8/2016 | Hong |
| 2006/0065265 | A1 | 3/2006 | Erdmann et al. |
| 2010/0018517 | A1 | 1/2010 | Chen |
| 2011/0132348 | A1 | 6/2011 | Smith |
| 2012/0020593 | A1 | 1/2012 | Rehage et al. |
| 2012/0097147 | A1 | 4/2012 | Steurer et al. |
| 2012/0138041 | A1 | 6/2012 | Jahrling |

(Continued)

FOREIGN PATENT DOCUMENTS

| | | |
|---|---|---|
| DE | 102008035078 | 9/2009 |
| DE | 102011081582 | 2/2013 |

(Continued)

*Primary Examiner* — Alfred Basichas
(74) *Attorney, Agent, or Firm* — Pearne & Gordon LLP

(57) ABSTRACT

A glide rack assembly removably installable within a cooking chamber. The assembly includes a support rack, an engagement member extending downward therefrom and being translatable between a fully retracted position and an extended position, and a locking arm. The locking arm is configured such that when the support rack is in the fully retracted position, the engagement member deflects said locking arm into an unlocked position wherein the locking arm does not cooperate with an embossment on a side wall of the cooking chamber. Further, when the support rack is translated from the fully retracted position, the engagement member does not deflect the locking arm such that the locking arm pivots to a locked position wherein the locking arm cooperates with the embossment such that the assembly is inhibited from being removed.

19 Claims, 4 Drawing Sheets

(56) References Cited

U.S. PATENT DOCUMENTS

| | | | |
|---|---|---|---|
| 2014/0265796 | A1 | 9/2014 | Rehage et al. |
| 2015/0101590 | A1 | 4/2015 | Armstrong et al. |
| 2015/0252843 | A1 | 9/2015 | Bachor et al. |

FOREIGN PATENT DOCUMENTS

| | | |
|---|---|---|
| EP | 2469182 | 6/2012 |
| EP | 2977685 | 1/2016 |
| WO | 2016055405 | 4/2016 |

GLIDE RACK ASSEMBLY FOR A COOKING CHAMBER

CROSS-REFERENCE TO RELATED APPLICATIONS

This application is a continuation of U.S. application Ser. No. 16/201,233, filed on Nov. 27, 2018, which is incorporated herein by reference.

BACKGROUND OF THE INVENTION

1. Field of the Invention

This application relates generally to a glide rack assembly removably installable within an oven and, more specifically, a glide rack assembly having a locking assembly that secures the assembly within a cooking chamber of the oven when a support rack of the assembly is translated from a fully retracted position.

2. Description of Related Art

Cooking appliances, such as ovens, generally include a rack for supporting a food product thereon. To interact/observe the food product during a cooking process, a user can open a door of the appliance and reach into the cooking chamber. This can be dangerous in that reaching into a cooking chamber may increase the risk of being burned. To address this, some cooking appliances include glide rack assemblies having a slidable rack supported on slides. The slides are themselves supported on a lower rack that typically is supported within the cooking chamber on support embossments provided in the lateral walls of the cavity, as is generally known. The lower rack remains fixed within the cavity, while the slidable rack can be translated between a fully retracted position within the cooking chamber, and an extended position where the rack extends out from the cooking chamber and into the kitchen for easier access of supported items. Specifically, when a user wishes to interact with the food product, the user need only grasp a front portion of the slidable rack and pull it outwards to the extended position, wherein the food product will be located outside of the cooking chamber. The lower rack remains within the cooking chamber to support the slides, and thereby the slidable rack in the extended position.

Glide rack assemblies are not without flaws. For example, when translating the slidable rack to an extended position outside the cooking chamber, the user may unintentionally also draw the lower rack with it, thereby withdrawing the entire assembly. This can be problematic, especially if the slidable rack is at that moment supporting a food item in the process of cooking.

To prevent this from occurring, some glide rack assemblies include a locking assembly which locks the assembly within the cooking chamber. Thus, the user can translate the slidable rack to the extended position without the entire assembly following. However, such locking assemblies tend to be complicated and also typically require manual manipulation by the user to switch the assembly between a locked and unlocked state, as desired, to prevent or permit removing the entire assembly from the cooking chamber.

BRIEF SUMMARY

In accordance with one aspect, there is a provided a glide rack assembly removably installable within a cooking chamber of an oven. The glide rack assembly includes a support rack that is translatable between a fully retracted position and an extended position. A locking arm is movable between a locked position wherein the locking arm inhibits removal of the glide rack assembly from the cooking chamber, and an unlocked position wherein the locking arm does not inhibit removal of the glide rack assembly. The locking arm is biased to the locked position. The support rack is configured such that when the support rack is in the fully retracted position the locking arm is deflected into the unlocked position against its bias. Further, when the support rack is translated from the fully retracted position the locking arm is permitted to return to the locked position in accordance with its bias.

In accordance with another aspect, there is provided an oven including a cooking chamber defined by a top wall, a bottom wall, a rear wall, and opposing side walls. A door is configured to provide selective access to the cooking chamber through a front opening of said cooking chamber, and a glide rack assembly is removably installable within the cooking chamber. The glide rack assembly includes a support rack that is translatable from within said cooking chamber to a withdrawn position at least partially extending from said front opening. A locking arm is movable between a locked position wherein the locking arm inhibits removal of the glide rack assembly from the cooking chamber, and an unlocked position wherein the locking arm does not inhibit removal of the glide rack assembly.

The locking arm is biased to the locked position. The support rack is configured such that when the support rack is retracted so that no portion thereof extends through said front opening, the locking arm is deflected into the unlocked position against its bias. Further, when the support rack is translated such that at least a portion thereof extends through said front opening, the locking arm is permitted to return to the locked position in accordance with its bias.

DETAILED DESCRIPTION

Relative language used herein is best understood with reference to the drawings, in which like numerals are used to identify like or similar items or features.

Figure 1:
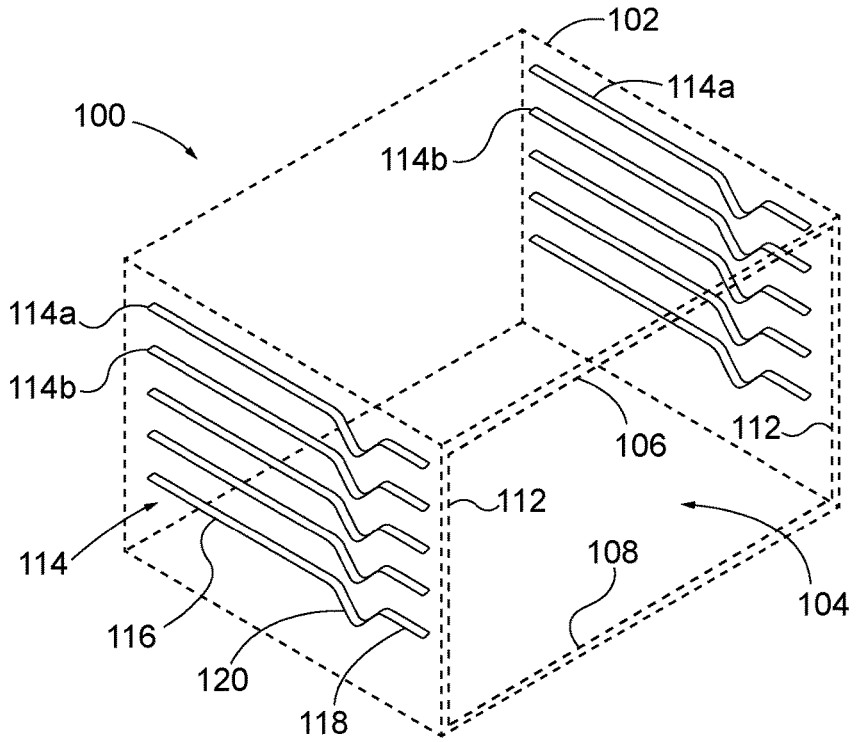
FIG. 1 is a schematic perspective view of a cooking chamber of an oven having side-wall embossments for supporting cooking racks therein.
Figure 2:
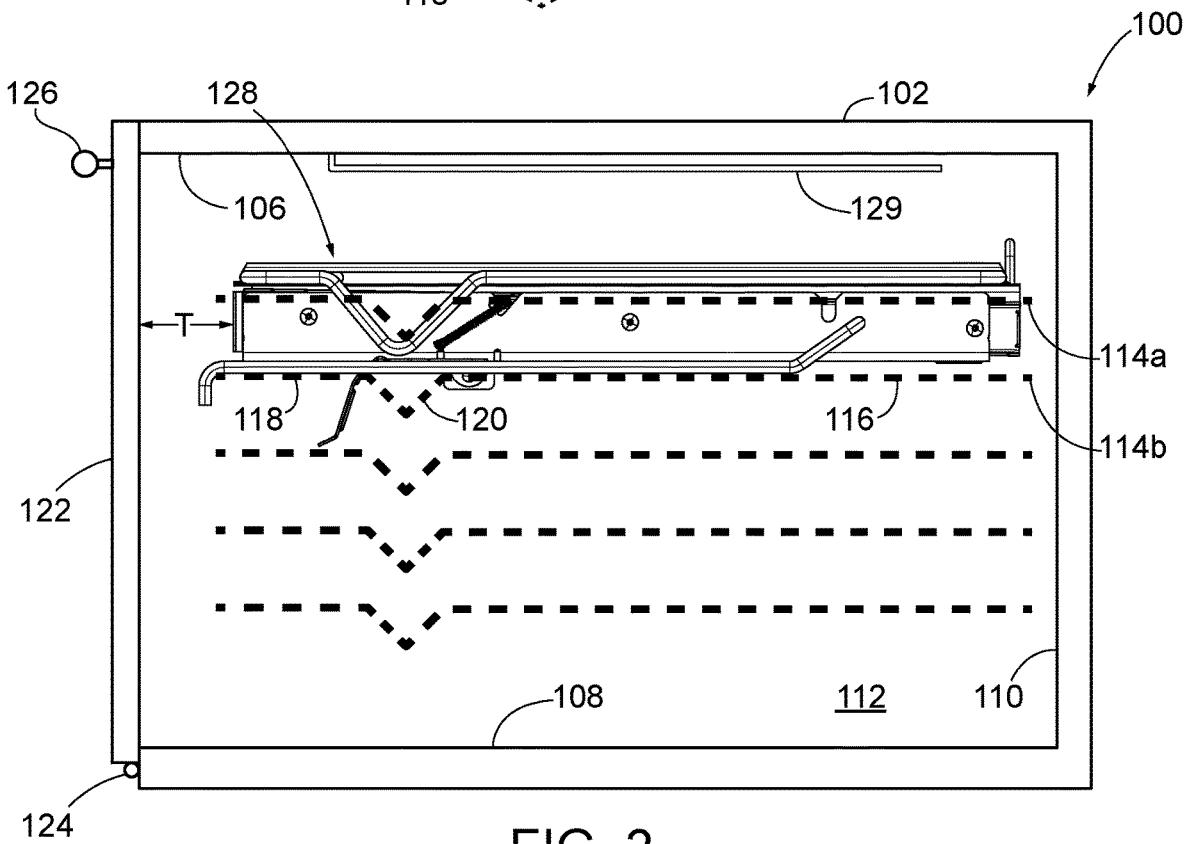
FIG. 2 is a schematic side view of the cooking chamber including a glide rack assembly removably installable therein, wherein the side-wall embossments are represented via broken lines.

Referring now to the drawings, FIGS. 1 and 2 schematically depict a cooking chamber 104 of an oven 100. While the below disclosures are made with respect to the oven 100, it is to be understood that the invention is not limited thereto and that cooking chambers of other cooking appliances are contemplated (e.g., microwaves, grills, etc.). The oven 100 can include an outer cabinet 102 having the cooking chamber 104 provided therein. The cooking chamber 104 is defined by a top wall 106, a bottom wall 108, a rear wall 110, and opposing side walls 112. An oven door 122 can be provided to reversibly close off an opening of the cooking chamber 104, thereby sealing that chamber 104 from the outside for cooking.

As shown in FIG. 1, each of the opposing side walls 112 includes a series of embossments 114 formed therein, vertically spaced on the wall 112 for supporting cooking racks at different levels within the cooking chamber 104. Specifically, each embossment 114 is arranged on a respective opposing side wall 112 and extends along the depth of that wall between the rear wall 110 and the forward opening of the cooking chamber 104. Further, each embossment 114 protrudes into the cooking chamber 104 in order to support lateral edges of cooking racks thereon. Each embossment 114 typically includes a first linear section 116 extending forward from adjacent the rear wall 110, and a second linear section 118 extending rearward from adjacent the front opening of the cooking chamber 104, with an elbow section 120 located therebetween. The first and second linear sections 116, 118 are essentially collinear. The elbow section 120 constitutes or defines an elbow extending downward from the first and second linear sections 116, 118 to an elbow apex directed toward the bottom wall 108. Typically, the entire embossment including the elbow section 120 and the first and second linear sections 116, 118 are formed integrally as a single, continuous embossment penetrating laterally into a volume of the cooking chamber 104 from the sidewall 112.

As further shown, a first set of embossments 114*a* are formed on the opposing side walls 112, respectively, vertically aligned with one another on a common, imaginary horizontal plane. The first set of embossments 114*a* is configured to support a cooking rack extending between them so that it rests horizontally within the cooking chamber 104 to support a food item thereon for cooking. A second set of embossments 114*b* are formed on the opposing side walls 112, respectively, at a vertical location below the first set 114*b* and also vertically aligned with one another on their own common, imaginary horizontal plane. Further sets of opposing and cooperating embossments may be provided in the opposing sidewalls 112, as shown. While FIG. 1 depicts the opposing side walls 112 having five different sets of embossments, it is contemplated that the opposing side walls 112 may have any number of embossments 114 and sets of embossments. Moreover, although it is shown that each embossment 114 is identical in structure, it is contemplated that the embossments 114 may have varying configurations.

With reference to FIG. 2, the oven 100 further includes a door 122 rotatably attached to the cabinet 102 (e.g., via a hinge 124). The door 122 provides selective access to the cooking chamber 104 through the front opening of said cooking chamber 104. That is, for a user to access the cooking chamber 104, the user pulls a handle 126 positioned on the door 122 to rotate the door 122 downwards. At least one heating 129 element is disposed within the cooking chamber 104 of the oven 100, for example adjacent the top wall 106, as shown. It is contemplated that the heating element 129 can be positioned adjacent other walls of the cooking chamber 104. Further, the oven 100 can include additional heating elements and/or other functional features (e.g., fans, vents, etc.).

A glide rack assembly 128 is removably installable or installed within the cooking chamber 104, supported on a set of the embossments 114 on the opposing sidewalls 112 thereof. That is, the glide rack assembly 128 is capable of being completely removed from the cooking chamber 104 for cleaning, maintenance, or replacement. In the figures, the glide rack assembly 128 is shown resting on the second set of embossments 114*b*. That is, the glide rack assembly 128 rests on the first and second linear sections 116, 118 of each embossment 114 of the second set of embossments 114*b*.

Figure 3:
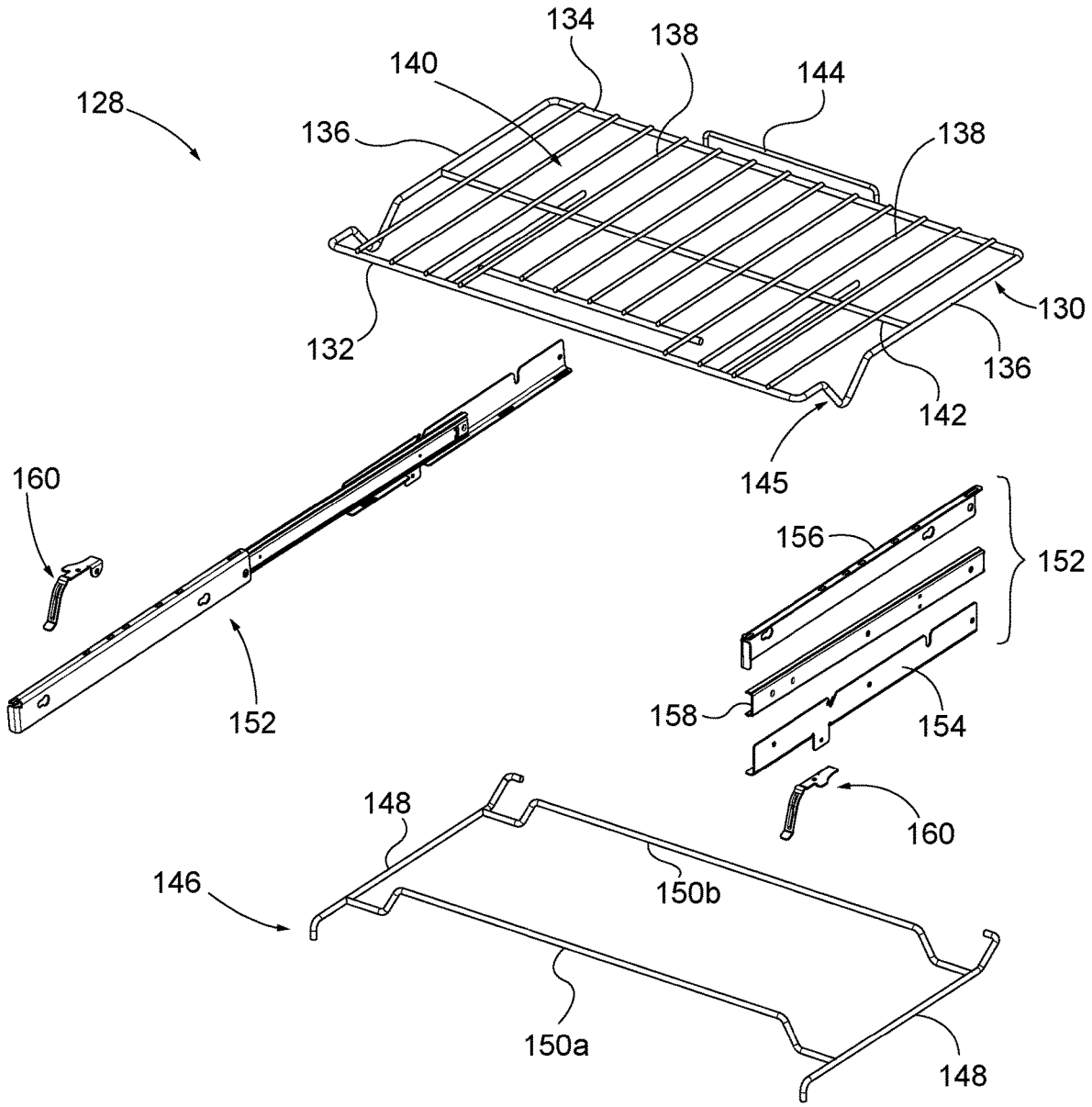
FIG. 3 is an exploded view of the glide rack assembly shown in FIG. 2.

Moving on to FIG. 3, the glide rack assembly 128 is shown in an exploded view. The glide rack assembly 128 includes a support rack 130 for supporting a food product thereon. The support rack 130 has a frame including a front bar 132, a rear bar 134 and opposing side bars 136. Elongated support bars 138 extend across the support rack 130 to create a supporting area 140 which supports the food product. Specifically, the elongated support bars 138 extend from the front bar 132 to the rear bar 134, in parallel. Further, the support rack 130 includes at least one cross bar 142 extending between the opposing side bars 136. The cross bar(s) 142 operate to mitigate sagging of the supporting area 140 of the support rack 130 when heavy food, cookware, or the like is placed on the supporting area 140. Sagging of the supporting area 140 can present problems with easily sliding the food product or cookware therefrom without interference from the front bar 132.

As shown, the front bar 132, rear bar 134 and opposing side bars 136 can be integrally formed together such that they are a single, continuous piece or rod formed into a substantially rectangular shape. However, the front bar 132, rear bar 134, and opposing side bars 136 can be separate and distinct elements that are attached together to form the frame in various manners (e.g., soldering, adhesives, fasteners, etc.). The support rack 130 further includes a stop bar 144 attached to the rear bar 134. Specifically, the stop bar 144 extends upwards from the rear bar 134 and is configured to prevent a food product and/or cookware from sliding off the supporting area 140 at the rear of the support rack 130.

The support rack 130 also includes a pair of engagement members 145 disposed at the opposing side bars 136, respectively, and which extend downwards from the support rack 130. Each engagement member 145 preferably is a V-shaped rod segment positioned adjacent to the front bar 132 of the support rack 130. As shown, the pair of engagement members 145 are formed integrally with the opposing side bars 136, respectively, as intermediate segments of the opposing side bars 136. Alternatively, the pair of engagement members 145 can be separate and distinct elements with respect to the support rack 130; for example, the pair of engagement members 145 can be fixedly secured to the opposing side bars 136, respectively, after the support rack 130 has already been formed.

The glide rack assembly 128 further includes a support frame 146 having opposing lateral support rods 148 spaced from and extending parallel to one another. The opposing lateral support rods 148 are connected via respective front and rear horizontal wire-stops 150*a*, 150*b* extending therebetween. The opposing lateral support rods 148 are oriented substantially parallel to the opposing side walls 112 of the cooking chamber 104, and the front and rear horizontal wire-stops 150*a*, 150*b* are arranged substantially parallel to the rear wall 110 of the cooking chamber 104. That is, the front and rear horizontal wire-stops 150*a*, 150*b* are arranged perpendicular to a direction of translational movement "T" of the support rack 130. Briefly moving back to FIG. 2, when the glide rack assembly 128 is in an installed position, as shown, the opposing lateral support rods 148 of the support frame 146 can rest directly on the second set of embossments 114*b*, respectively, in order to support the glide rack assembly 128 within the cooking chamber 104.

As further shown in FIG. 3, the glide rack assembly 128 includes a pair of slide assemblies 152 configured to support the support rack 130 on the support frame 146, and to allow the support rack 130 to translate between a retracted position and an extended position relative to the support frame 146. In other words, the support rack 130 is translatable from within said cooking chamber 104 to a withdrawn position at least partially extending from said front opening. Further, when the support rack 130 is retracted (i.e., to the fully retracted position), no portion of the support rack 130 extends through said front opening.

Each slide 152 includes a fixed slide 154 attached to the support frame 146, a moveable slide 156 attached to the support rack 130, and a slide bearing 158 adapted to permit the moveable slide 156 to advance and withdraw telescopically with respect to the fixed slide 154. As will be discussed further below, the glide rack assembly 128 further includes a locking assembly 160 configured to permit removal of the entire glide rack assembly 128 from the cooking chamber 104 when the support rack 130 is fully retracted, and to prevent removal thereof when the support rack 130 has been extended from its fully retracted position.

Figure 4A:
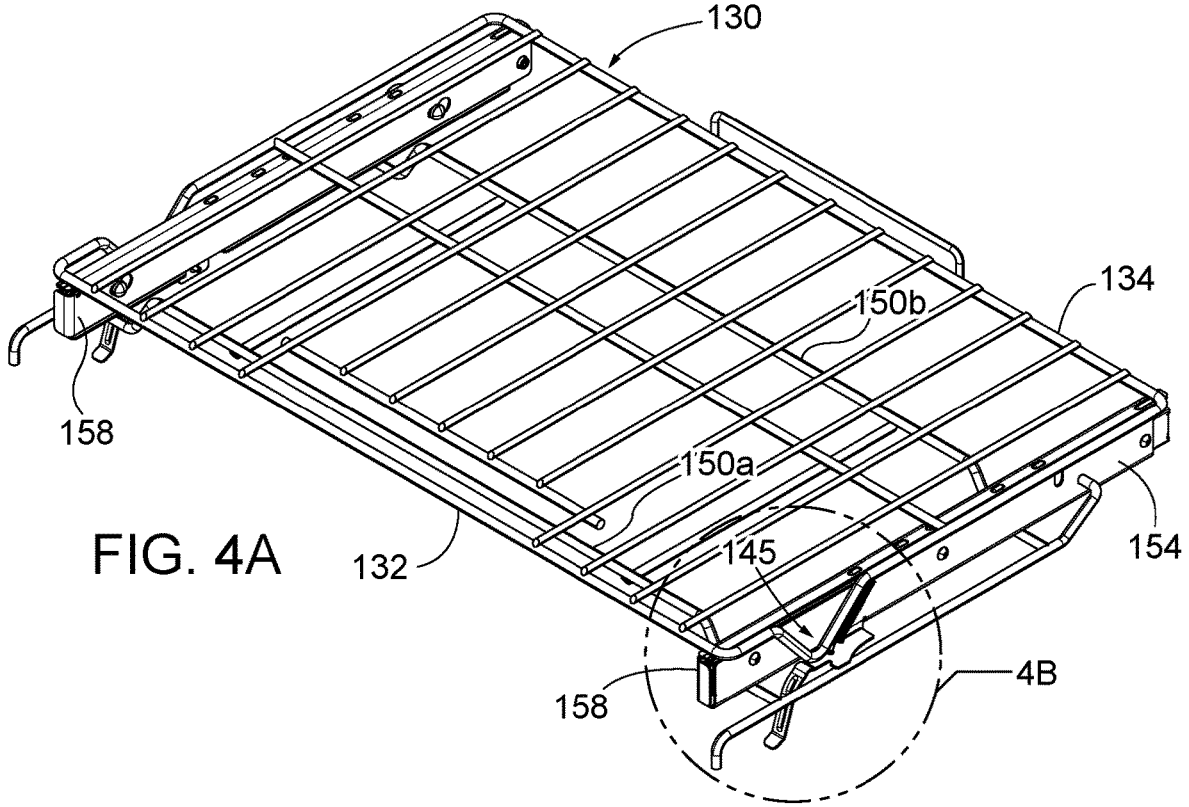
FIG. 4A is perspective view of the glide rack assembly shown in FIG. 2, shown fully assembled.

Moving on to FIG. 4A, the glide rack assembly 128 is shown in the fully retracted position. As shown, each fixed slide 154 is located above and attached (i.e., via welding, soldering, mechanical fasteners, etc.) to the front and rear horizontal wire-stops 150*a*, 150*b* of the support frame 146. Further, the movable slides 156 are attached to the support rack 130; e.g. to the front and rear bars 132, 134 thereof, preferably laterally inwards from the respective engagement members 145.

Preferably, a locking assembly 160 as herein described is disposed at either lateral side of the glide rack assembly 128, to uniformly inhibit or permit withdrawal of that assembly 128 from both sides of the cooking chamber 104. The configuration, structure, and function of each said locking assembly 160 will now be discussed. For brevity, reference will be made to only a single one of them, however, on the understanding that the below disclosure applies to both said locking assemblies 160 located at either side of the glide rack assembly 128. Moreover, it is to be understood that the pair of locking assemblies 160 work in concert with one another to permit/inhibit removal of the glide rack assembly 128 from the cooking chamber 104 and that the operation thereof preferably occurs simultaneously as the support rack 130 is uniformly translated between extended and fully retracted positions.

Figure 4B:
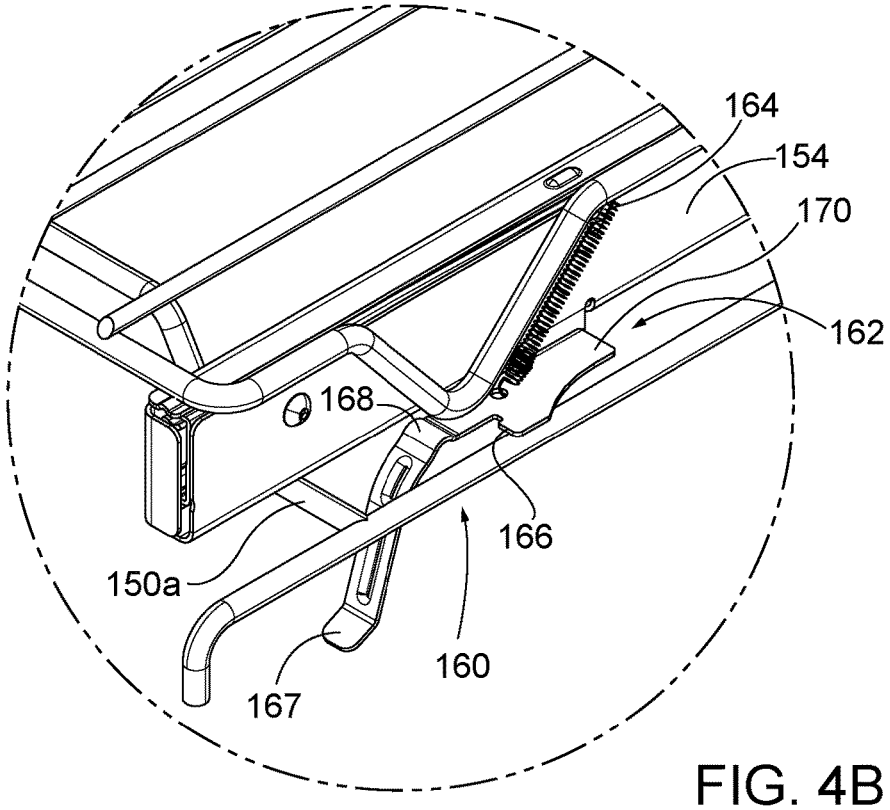
FIG. 4B is an enlarged view of an engagement member and a locking arm depicted at "4B" in FIG. 4A.

With reference to FIG. 4B, an enlarged view of one of the locking assemblies 160 is shown. The locking assembly 160 includes a locking arm 162 pivotally attached to the fixed slide 154 such that it is vertically pivotable between a locked position (shown in FIG. 5B) and an unlocked position (shown in FIG. 5A). That is, the locking arm 162 is pivotable about a horizontal axis that is substantially parallel to the front bar 132 of the support rack 130. Moreover, the locking assembly 160 includes a spring 164 that biases the locking arm 162 into the locked position. The spring 164 can be a tension spring having a first end secured to the fixed slide 154 and a second end secured to the locking arm 162. It is contemplated that the spring 164 can have other configurations (e.g., compression spring, torsion spring, etc.) as well as other attachment locations which promote biasing of the locking arm 162 into the locked position.

As further shown in FIG. 4B, the locking arm 162 includes a tab 166 that protrudes outwards therefrom. Specifically, the tab 166 extends laterally outwards and away from the support rack 130 (i.e., towards a respective opposing side wall 112 of the cooking chamber 104) and, as will be discussed further below, is configured to cooperate (e.g., engage) with a respective embossment 114 located in the adjacent side wall 112 of the cooking chamber 104 located above the embossment 114*b* on which the rack assembly 128 rests (e.g. an embossment 114 of the first set of embossments 114*a* in the figures). The locking arm 162 is disposed such that a distal end 167 thereof is positioned beneath (i.e., vertically below) the front horizontal wire-stop 150*a*. As such, when the locking arm 162 pivots to the locked position (in accordance with its bias), the distal end 167 of the locking arm 162 contacts the front horizontal wire-stop 150*a* and prevents further pivotal movement of the locking arm 162 based on the spring bias.

The locking arm 162 further includes a detent protrusion 168 in a top surface 170 thereof. As will be further discussed below, the detent protrusion 168 can help minimize unintended withdrawal of the support rack 130 from its fully retracted position. The detent protrusion 168 is formed integral with the locking arm 162, as a part thereof. Alternatively, the detent protrusion 168 may be a separate and distinct element that is attached to a top surface 170 of the locking arm 162 in order to provide a detent over which the engagement member 145 of the support rack 130 must pass to move from its fully retracted position.

Figure 5A:
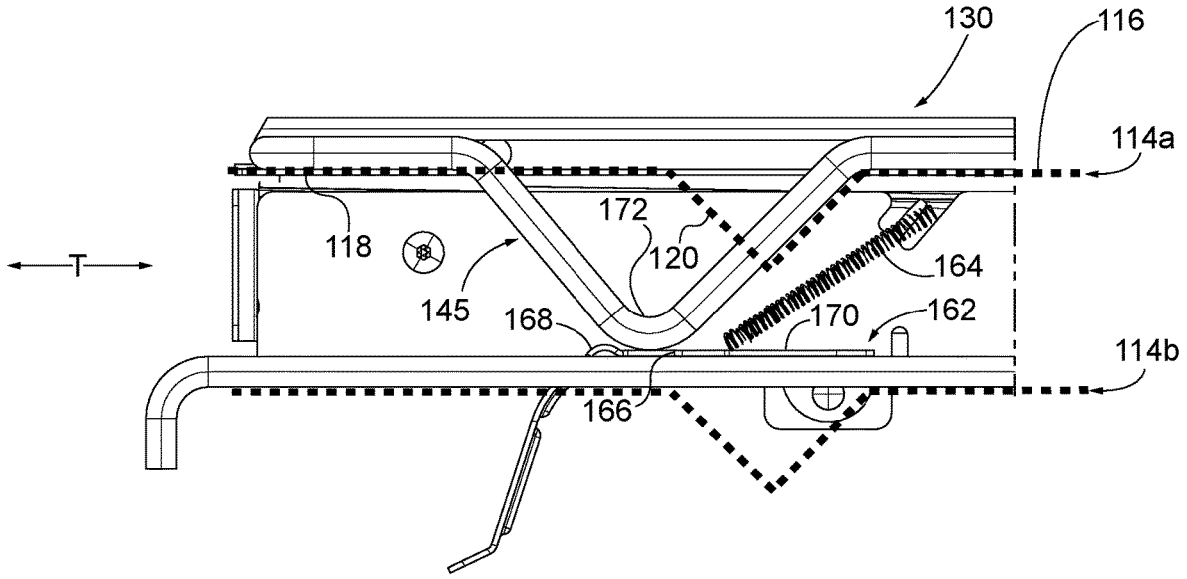
FIG. 5A is a schematic side view of a forward end of the glide rack assembly in a fully retracted position.

Moving on to FIG. 5A, the support rack 130 is shown in the fully retracted position. In this position, the engagement member 145 deflects the locking arm 162 into the unlocked position (i.e., against its bias). That is, when the support rack 130 is in the fully retracted position, the engagement member 145 is positioned vertically above the locking arm 162 such that the engagement member 145 physically contacts the top surface 170 of the locking arm 162 and deflects the locking arm 162 into the unlocked position against the biasing force of the spring 164. In this orientation, the locking arm 162 will not cooperate or interfere with an embossment 114 (i.e., in the illustrated embodiment the first embossment 114*a*), thereby permitting the glide rack assembly 128 to be removed from the cooking chamber 104. In other words, when the support rack 130 is in the fully retracted position, the engagement member 145 deflects the locking arm 162 into an unlocked position, out of engagement with a cooperating embossment in the side wall of the oven chamber (i.e. downwards in the illustrated embodiment), thereby allowing a user to remove the entire glide rack assembly 128 from the cooking chamber 104.

As shown, the detent protrusion 168 is positioned such that when the locking arm 162 is in the unlocked position, the detent protrusion 168 is located in front of a contacting segment 172 of the engagement member 145 with respect to the translational movement "T" of the support rack 130. That is, the detent protrusion 168 is located farther from the rear wall 110 of the cooking chamber 104 than the contacting segment 172 of the engagement member 145. As such, the detent protrusion 168 acts as a modest obstacle to be negotiated by the contacting segment 172 of the engagement member 145 in order to withdraw the support rack 130 from the fully retracted position. In this manner, accidental withdrawal (e.g., occurring when a user places a food product, cookware, utensil, etc., on the supporting area 140) of the fully inserted support rack 130 is made less likely.

In order to withdraw the support rack 130 from the fully retracted position to an extended position, a user must apply sufficient force to overcome the interference between the engagement member 145 and the detent protrusion 168. That is, the user must pull the support rack 130 outwards with ample force to allow the contacting segment 172 of the engagement member 145 to negotiate the detent protrusion 168. Thereafter, the support rack 130 is free to translate outwards to an extended position.

Figure 5B:
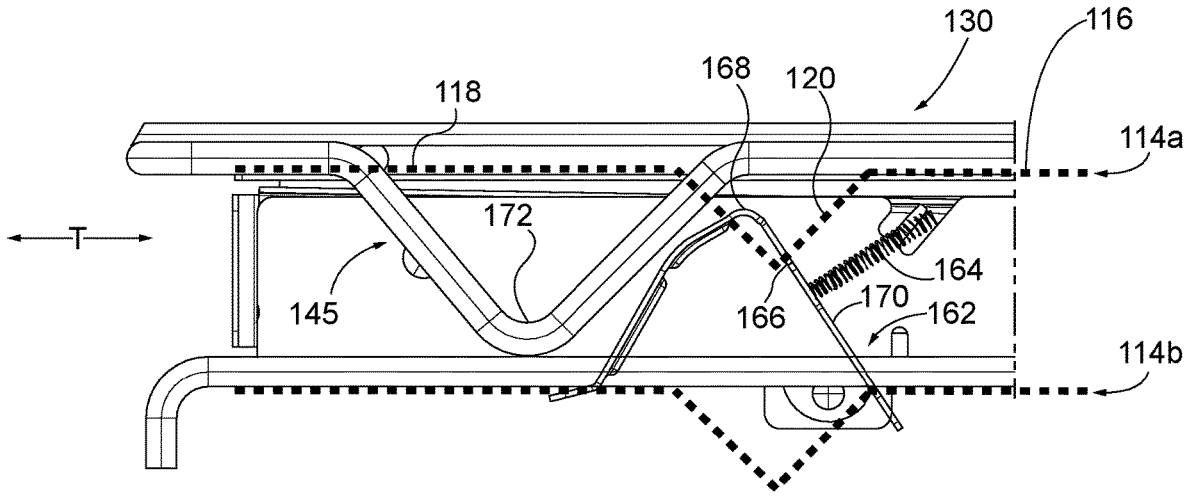
FIG. 5B is a schematic side view of the glide rack assembly in a forward position, wherein the slidable rack has been advanced forward from its fully retracted position toward (but not necessarily all the way to) a fully extended position.

With respect to FIG. 5B, when the support rack 130 is withdrawn from the fully retracted position such that the contacting segment 172 of the engagement member 145 traverses the detent protrusion 168, the engagement member 145 is moved out of engagement with the locking arm 162 such that the biasing force of the spring 164 causes the locking arm 162 to pivot from the unlocked position to the locked position. As briefly mentioned above, the locking arm 162 will pivot based on the biasing force of the spring until it reaches the locked position where the distal end 167 of the locking arm 162 physically contacts the front horizontal wire-stop 150*a*. When the locking arm 162 is in the locked position, the locking arm 162 interferes with (i.e., is positioned laterally adjacent to) a cooperating embossment (e.g. the first embossment 114*a* in the figures) on the side wall 112 of the cooking chamber 104. More specifically, when the glide rack assembly 128 is installed within the cooking chamber 104 and when the locking arm 162 is in the locked position, the tab 166 is aligned into engagement with the cooperating embossment (e.g. the elbow section 120 of the first embossment 114*a* in the illustrated embodiment) such that interference between the tab 166 and the embossment 114 will inhibit removal of the support frame 146, and therefore of the glide rack assembly 128 as a whole, when the support rack 130 is in an extended position. In this manner, the glide rack assembly 128 is prohibited from being removed from the cooking chamber 104 while the support rack 130 is extended.

Accordingly, the cooperating locking assemblies 160 lock the glide rack assembly 128 within the cooking chamber 104 automatically whenever the support rack 130 is withdrawn from its fully retracted position, but permit removal of the entire glide rack assembly 128 when the support rack 130 is in the fully retracted position. No subsequent or secondary manual or user manipulation is required to lock or unlock the glide rack assembly 128 so that it can be removed from (or is locked in place within) the cooking chamber 104. That is, advancement of the support rack 130 into the fully retracted position within the cooking chamber automatically actuates the locking assembly 160 to unlock the glide rack assembly 128 so that it can be removed from the cooking chamber 104. Conversely, withdrawal of the support rack 130 from the fully retracted position while the glide rack assembly 128 is seated on opposing embossments 114 within the cooking chamber 104 automatically actuates the locking assemblies 160 to lock the glide rack assembly 128 in place, so that it cannot be removed from the cooking chamber 104 whenever the support rack 130 is not fully retracted. There is no additional step required to lock the glide rack assembly 128 within the cooking chamber 104 before withdrawing the support rack 130 outwards.

The invention has been described with reference to the example embodiments described above. Modifications and alterations will occur to others upon a reading and understanding of this specification. Example embodiments incorporation one or more aspects of the invention are intended to include all such modifications and alterations insofar as they come within the scope of the appended claims.

What is claimed is:

1. A glide rack assembly removably installable within a cooking chamber of an oven, the glide rack assembly comprising:

a support rack being translatable between a fully retracted position and an extended position; and a locking arm movable between a locked position wherein the locking arm inhibits removal of the glide rack assembly from the cooking chamber, and an unlocked position wherein the locking arm does not inhibit removal of the glide rack assembly, the locking arm being biased to the locked position, said support rack being configured such that when the support rack is in the fully retracted position the locking arm is deflected into the unlocked position against its bias, wherein translation of the support rack away from the fully retracted position automatically results in the locking arm returning to the locked position in accordance with its bias, such that movement of the locking arm between said unlocked and locked positions occurs in dependence on translation of the support rack between the fully retracted position and the extended position, respectively.

2. The glide rack assembly of claim 1, further comprising a slide assembly supporting said support rack and configured to facilitate translation thereof between said extended and fully retracted positions, said slide assembly including a fixed slide and a moveable slide, said locking arm being attached to said fixed slide.

3. The glide rack assembly of claim 2, comprising two said slide assemblies translatably supporting said support rack, one each at opposing lateral edges of said support rack adjacent respective side walls of said cooking chamber when installed, and two said locking arms, one each associated with the respective lateral edges of said support rack.

4. The glide rack assembly of claim 2, the support rack having a front bar, a rear bar, and opposing side bars, and an engagement member depending from or formed integrally with one of the opposing side bars, the engagement member being configured to deflect the locking arm into the unlocked position against its bias when the support rack is in the fully retracted position.

5. The glide rack assembly of claim 4, the engagement member being an elbow formed in said one of the opposing side bars.

6. The glide rack assembly of claim 2, further comprising a support frame that rests on an embossment on a side wall of the cooking chamber to support said glide rack assembly when installed within the cooking chamber.

7. The glide rack assembly of claim 6, the support frame being secured to the fixed slide.

8. The glide rack assembly of claim 7, said support frame comprising a horizontal wire stop extending between opposing lateral support rods thereof, a distal end of the locking arm being located below the wire-stop such that the locking arm is biased against and contacts the wire-stop in the locked position.

9. The glide rack assembly of claim 2, the locking arm being biased to the locked position via a spring.

10. The glide rack assembly of claim 9, said spring being anchored from the fixed slide.

11. The glide rack assembly of claim 1, the locking arm comprising a tab that protrudes laterally outward, such that attempted withdrawal of the glide rack assembly from the cooking chamber when the locking arm is in the locked position results in said tab contacting an embossment on a side wall of the cooking chamber thereby inhibiting further withdrawal of the glide rack assembly.

12. The glide rack assembly of claim 1, the locking arm comprising a detent protrusion extending from a top surface thereof and configured such that said support rack must negotiate said protrusion upon withdrawal of said support rack from the fully retracted position, said protrusion thereby presenting an obstacle to such withdrawal of said support rack.

13. The glide rack assembly of claim 1, wherein when the locking arm is in the locked position the locking arm cooperates with a first embossment on a side wall of the cooking chamber when installed to inhibit removal of the glide rack assembly from the cooking chamber, and when the locking arm is in the unlocked position the locking arm no longer cooperates with the first embossment.

14. The glide rack assembly of claim 13, further comprising a support frame that rests on a second embossment to support said glide rack assembly when installed within the cooking chamber, the second embossment being positioned below the first embossment.

15. An oven comprising:

a cooking chamber defined by a top wall, a bottom wall, a rear wall, and opposing side walls;

a door configured to provide selective access to the cooking chamber through a front opening of said cooking chamber; and a glide rack assembly removably installable within the cooking chamber, the glide rack assembly comprising:

a support rack being translatable from within said cooking chamber to a withdrawn position at least partially extending from said front opening; and a locking arm movable between a locked position wherein the locking arm inhibits removal of the glide rack assembly from the cooking chamber, and an unlocked position wherein the locking arm does not inhibit removal of the glide rack assembly, the locking arm being biased to the locked position, said support rack being configured such that when the support rack is retracted so that no portion thereof extends through said front opening, the locking arm is deflected into the unlocked position against its bias, wherein translation of the support rack such that at least a portion thereof extends through said front opening automatically results in the locking arm returning to the locked position in accordance with its bias, such that movement of the locking arm between said unlocked and locked positions occurs in dependence on translation of the support rack.

16. The oven of claim 15, further comprising a pair of slide assemblies translatably supporting said support rack at respective lateral edges of said support rack, each of said pair of slide assemblies comprising a fixed slide and a moveable slide, the locking arm being attached to one of the fixed slides.

17. The oven of claim 16, the glide rack assembly further comprising a support frame that rests on respective embossments formed respectively in said opposing sidewalls, the support frame being secured to the fixed slides.

18. The oven of claim 17, said support frame comprising a horizontal wire stop extending between opposing lateral support rods thereof, a distal end of the locking arm being located below the wire-stop such that the locking arm is biased against and contacts the wire-stop in the locked position.

19. The oven of claim 15, the locking arm comprising a detent protrusion extending from a top surface thereof and configured such that said support rack must negotiate said protrusion upon extension of said support rack, said protrusion thereby presenting an obstacle to extension of said support rack from within said cooking chamber to at least partially extend through said front opening.

* * * * *